United States Patent [19]

Stamper

[11] 4,403,926

[45] Sep. 13, 1983

[54] BARREL PUMP

[75] Inventor: Eugene E. Stamper, Spencer, Iowa

[73] Assignee: Witco Chemical Corporation, New York, N.Y.

[21] Appl. No.: 235,099

[22] Filed: Feb. 17, 1981

[51] Int. Cl.[3] ..... F04B 7/04

[52] U.S. Cl. ..... 417/553; 251/231; 222/383

[58] Field of Search ..... 251/231; 222/353, 256; 417/553, 511, 512, 513

[56] References Cited

U.S. PATENT DOCUMENTS

| | | | |
|---|---|---|---|
| 1,485,958 | 3/1924 | Bridgham | 251/231 X |
| 1,630,133 | 5/1927 | Murphy | 251/231 |
| 1,718,985 | 7/1929 | Scoville | 222/383 |
| 3,473,479 | 10/1969 | Sundholm | 417/553 |
| 3,752,604 | 8/1973 | Dorn | 417/553 |

*Primary Examiner*—Alan Cohan

*Attorney, Agent, or Firm*—Wallenstein, Wagner, Hattis, Strampel & Aubel

[57] ABSTRACT

A barrel pump having a handle attached to a freely rotatable ring-like member carried on the head portion of the pump whereby the handle can be freely swiveled in relation to the head portion to enable the handle to be positioned at substantially any angle with relation to the spout of the pump.

1 Claim, 4 Drawing Figures

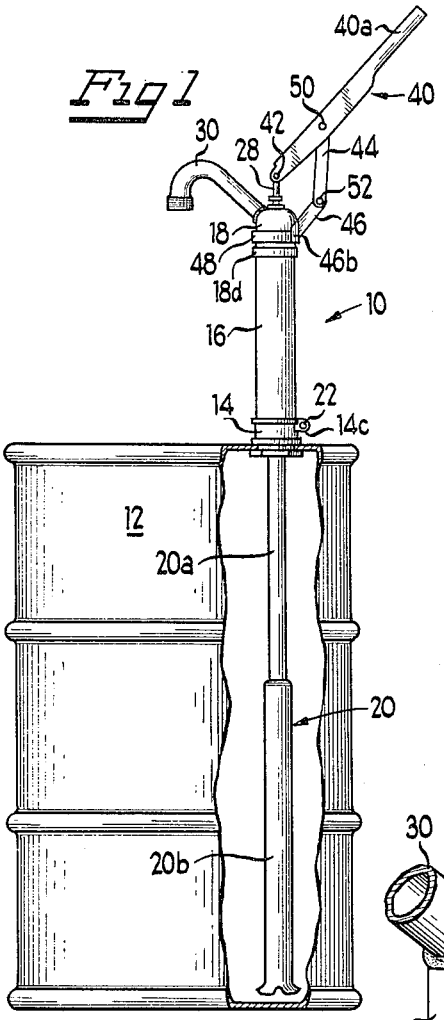
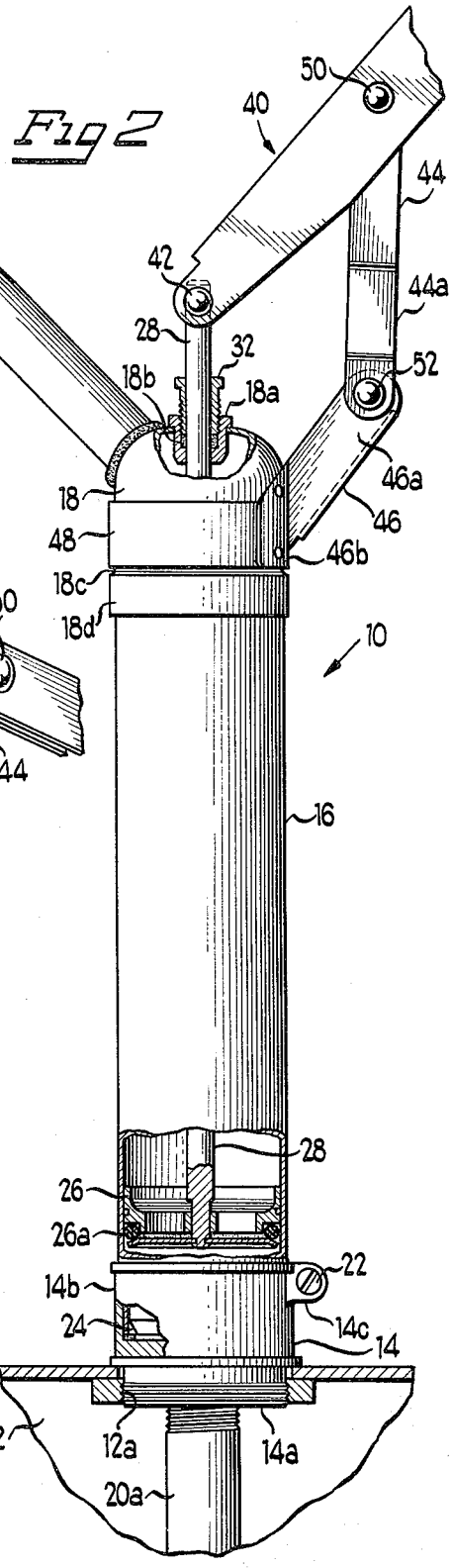
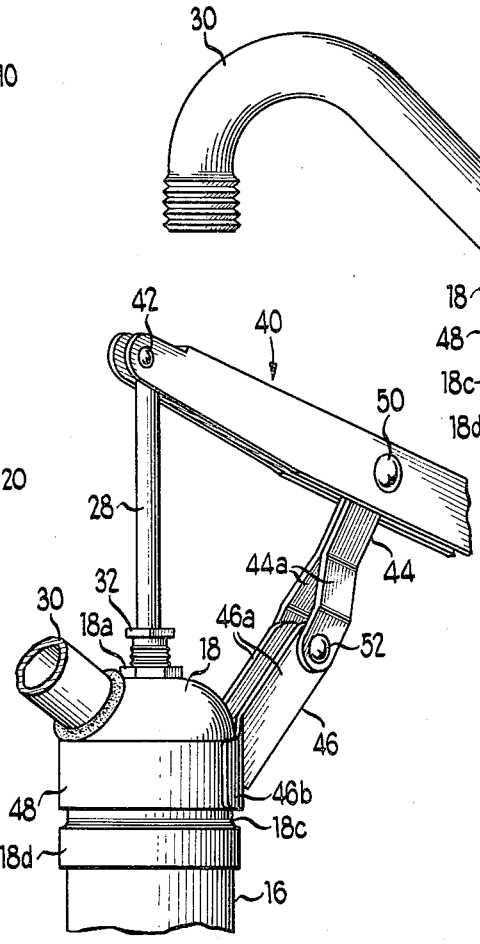
Fig 3
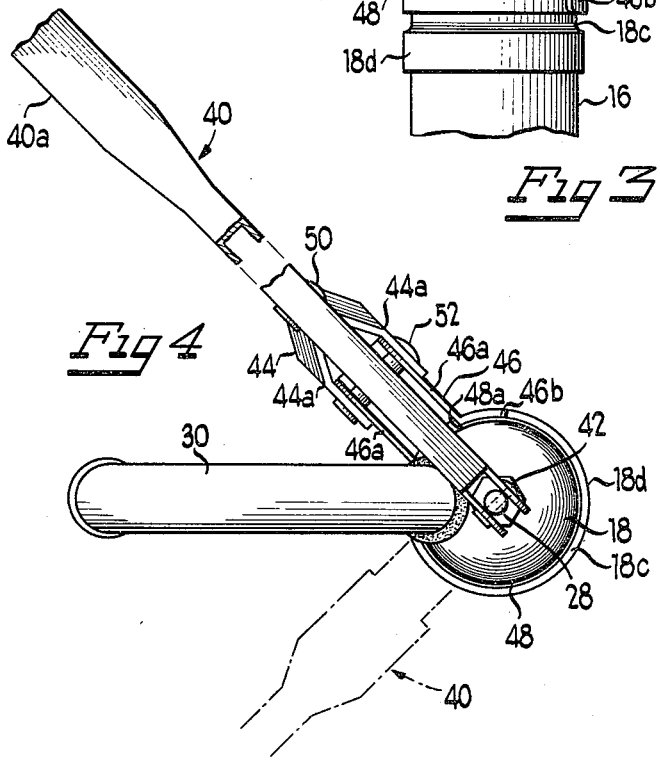
Fig 4

BARREL PUMP

The present invention relates to an improved barrel pump of the type used in connection with barrels or drums containing fluid lubricants, agriculture and industrial chemicals, as well as other liquids, including automotive additives.

Barrel pumps of the type used for delivering fluid from a metal barrel or drum are disclosed in U.S. Pat. Nos. 3,473,479, 3,743,448 and 3,820,800. Typically, such pumps comprise a base member adapted to be secured in a threaded opening or bung in the top of a barrel or drum, a cylinder supported on the base member, a head positioned on the upper end of the cylinder, a spout on the head, and a pump handle secured to the head by a bracket. The cylinder is provided with a piston and piston rod. The upper end of the piston rod extends through the head of the pump and is pivotally attached to an end of the pump handle.

In each of the pumps shown in the aforementioned patents, provision is made from enabling the cylinder to be rotated without disengaging the base member from the barrel or drum. Rotation of the cylinder is required in order to position the spout of the pump in a desired position with relation to the top of the barrel or drum on which the pump is mounted. Since the bracket which supports the pump handle is rigidly secured, as by welding, to the head of the pump, rotation of the cylinder to adjust the spout with relation to the top of the barrel or drum, results in the pump handle rotating through an arc equal to that through which the spout is rotated. This, of course, dictates where an operator of the pump must stand to dispense fluid from the barrel or drum. In situations where the available space around the barrel or drum is limited, or the drum or barrel is backed up to a wall, or articles are stacked next to the barrel or drum, operation of the pump can be awkward, at the least, and can be especially so depending upon whether the operator is righthanded or lefthanded.

In accordance wth the present invention, an improved barrel pump is provided which enables an operator of the pump to easily and quickly position the handle of the pump at any desired angle with relation to the spout of the pump. No bolts, nuts or screws are required to be loosened to reposition the handle, the repositioning can be made with equal facility to accommodate a righthanded or lefthanded operator irrespective of space conditions in the area of the barrel or drum on which the pump is mounted.

The foregoing, and other advantages and features of the barrel pump of the present invention, will become clear to those skilled in the art upon reference to the accompanying specification, claims and drawings wherein:

FIG. 1 is a side view in elevation showing an embodiment of the barrel pump of this invention in operative position on a barrel or drum;

FIG. 2 is an enlarged fragmentary side view in elevation, partly in section, of the embodiment of the barrel pump illustrated in FIG. 1;

FIG. 3 is a fragmentary view in perspective of the upper or head end of said embodiment of the barrel pump; and FIG. 4 is a fragmentary top plan view of said embodiment of the barrel pump showing the freely swivelable handle in two different positions with relation to the spout of the pump.

Referring, now, in greater detail to the drawings, FIGS. 1 and 2, in particular, an embodiment of the barrel pump 10 of this invention is shown threadedly engaged on the top of a barrel or drum 2. The bung or threaded hole 12*a* in the top of the barrel or drum is usually located adjacent the rim of the barrel top so that adequate space will be available on the barrel top to support a smaller container in which fluid from the barrel or drum 12 is to be pumped.

The pump 10, as illustrated, comprises a base 14, an elongated pump cylinder 16, and a head portion 18. The base member 14 has a downwardly extending externally threaded skirt 14*a* by means of which the pump 10 is secured to the threaded bung hole 12*a* of the barrel or drum 12. An internally threaded extension (not shown) concentrically located with relation to the skirt 14*a* is provided on the base member 14 for engaging the externally threaded upper end of a section tube 20. The tube 20 advantageously comprises inner and outer telescoping sections 20*a* and 20*b* which form a continuous conduit from the bottom of the barrel or drum 112 to the base member 14 of the pump 10. The base member 14 has an upwardly extending cylinder engaging cup 14*b*. The wall of the cup 14*b* has a vertical slot (not shown) on each side of which lugs (14*c*—14*c* are positioned. The lugs 14*c*—14*c* are provided with tapped holes therethrough for receiving a bolt 22. Sealing means such as a gasket 24 is located at the base of the cup 14*b* for forming a fluid tight seal between the cup 14*b* of the base member 14 and the lower end of the cylinder 16.

Positioned internally of the cylinder 16 is a pistion 26 to which is secured a piston rod 28. As shown, the piston 26 carries an O-ring 26*a* which is in contact with the inner wall of the cylinder 16 thereby preventing fluid passage between the O-ring 26*a* and the inner wall of the cylinder 16. The operation of the piston 26 is known in the art and does not require explanation here.

The head portion 18 of the pump 10 is carried on the upper end of the cylinder 16, and is provided with a spout 30 through which fluid from the barrel or drum 12 is dispensed. The head 18 has a centrally located opening in the upper end thereof in which a piston rod guide member 18*a* is secured. The upper end of the guide member 18*a* is tapped, and receives an externally threaded bushing 32. The guide member 18*a* and the bushing 32 are each provided with a central bore through which the upper end of the piston rod 28 slidably extends. Sealing means such as O-ring 18*b* is positioned in the guide member 18*a* to provide a fluid tight seal between the rod 28 and the guide member 18*a*. The upper end of the piston rod 28 is pivotally joined to the end of a handle 40 by means of a cotter pin 42.

The details of the barrel pump 10 described up to this point are common to various barrel pumps known in the art, particularly, the barrel pumps disclosed in the aforementioned U.S. patents.

The barrel pump of this invention is provided with a unique handle arrangement which includes the handle 40, a link member 44, a channel-shaped bracket 46 and a freely turnable or swivelable collar or ring-like member 48 concentrically positioned on the head portion 18 of the pump. The handle 40, as indicated above, is pivotally attached at one end to the upper end of the piston rod 28 by means of the pin 42. The handle 40, from the point of its connection to the piston rod 28 to its gripping portion 40*a*, is channeled, and is pivotally secured to the upper end of the link member 44 by means of a pin or rivet 50. The lower end of the link member 44 advantageously is bifurcated to provide a pair of bracket engaging arms 44*a*—44*a* which are pivotally connected to the upper ends of the side walls 46*a*—46*a* of the channel-shaped bracket 46 by a pin or rivet 52. The lower ends of the side walls 46*a*—46*a* of the bracket 46 desirably are formed into ears or extensions 46*b*—46*b* which are secured, as by spot welding, to the ring-like member 48 on the head portion 18. The extensions 46*b*—46*b* desirably have a curvature impressed upon them which conforms to the radius of curvature of the ring-like member 48 to facilitate attachment of the extensions 46*b*—46*b* to the ring-like member 48.

The ring-like member 48 may comprise a section of a cylinder, or, preferably, it may comprise a strip of metal having a length which is less than the circumference of the head portion 18 which is bent to provide it with a radius of curvature conforming to that of the head portion 18. In this preferred form of the ring-like member 48, the extensions 46*b*—46*b* of the bracket 46 are secured along the spaced ends 48*a*—48*a* of the bent metal strip (see FIG. 4).

As best shown in FIGS. 2 and 3, the ring-like member 48 is positioned below the point at which the inner end of the spout 30 is joined to the head portion 18 and above a shoulder 18*c* formed by an annular, cylinder-receiving flared section 18*d* at the base of the head portion 18. This arrangement acts to limit or restrict the vertical movement of the ring-like member 48 on the head portion 18 during operation of the pump with the handle 40 while at the same time enabling an operator to freely circumferentially swing the handle 40 to any desired position with relation to the spout 30. The substantial angle or arc through which the handle 40 can be swiveled or turned is best illustrated in FIG. 4 where the extreme positions of the handle 40 in relation to the spout 30 are shown in solid and broken lines. The angle, or arc, as can be seen, approaches 360 degrees.

While in the foregoing specification, a detailed description of a preferred embodiment of the barrel pump of this invention has been set forth for purposes of illustrating the invention, it should be understood that many of the details herein described may be varied or modified by those skilled in the art without departing from the spirit and scope of the invention.

What is claimed is:

1. In a upright mounted pump comprising a cylinder having an upper end provided with a head portion and a lower end provided with means for releasably securing the cylinder on a barrel or drum containing a fluid, said head portion being provided with an annular shoulder and having a spout extending outwardly therefrom in spaced relation to said annular shoulder, a piston and a piston rod for the cylinder, the upper end of the piston rod extending through and outwardly of the head portion on the upper end of the cylinder, a handle for the pump, said handle being pivotally joined at one end to the upper end of said piston rod, a ring-like member having a radius of curvature and a circumference of greater than ½ of the circumference of said head portion positioned on the head portion between the annular shoulder and the base of the spout extending outwardly therefrom, said shoulder and the base of the spout cooperating to limit the extent of the upward and downward movement of the ring-like member on the head portion, said ring-like member being freely turnable at all times on the head portion on the upper end of the cylinder, and interconnecting means comprising bifurcated ear extensions having end members having a radius of curvature substantially conforming to the radius of curvature of said ring-like member welded to the ring-like member at its extremities and to the handle whereby the handle can be freely swivelled with relation to the upper end of the pump to enable the handle to be operated at substantially any desired angle with relation to the spout on the head portion.

* * * * *